US007081035B2

(12) United States Patent
Kawakami

(10) Patent No.: US 7,081,035 B2
(45) Date of Patent: Jul. 25, 2006

(54) WOMAN'S CLOTHING HAVING A FUNCTION OF PROTECTING A BREAST

(75) Inventor: Maki Kawakami, Kyoto (JP)

(73) Assignee: Wacoal Corp., Kyoto (JP)

( * ) Notice: Subject to any disclaimer, the term of this patent is extended or adjusted under 35 U.S.C. 154(b) by 0 days.

(21) Appl. No.: 10/903,247

(22) Filed: Jul. 30, 2004

(65) Prior Publication Data

US 2006/0025043 A1 Feb. 2, 2006

(51) Int. Cl.
*A41C 3/12* (2006.01)
*A41C 3/00* (2006.01)

(52) U.S. Cl. ..... 450/59; 450/65; 450/66

(58) Field of Classification Search ..... 450/59–62, 450/64–66, 74–76, 92; 2/69, 67
See application file for complete search history.

(56) References Cited

U.S. PATENT DOCUMENTS 4,698,847 A * 10/1987 Yoshihara ..... 2/69

FOREIGN PATENT DOCUMENTS

| | | |
|---|---|---|
| JP | S57-154705 | 9/1982 |
| JP | S59-125910 | 8/1984 |
| JP | 09-296308 | 11/1997 |
| JP | 11-286803 | 10/1999 |

OTHER PUBLICATIONS

Japanese Utility Model Laid-Open Publication No. S57-154705 published on Sep. 29, 1982.
Japanese Utility Model Laid-Open Publication No. S59-125910 published on Aug. 24, 1984.
Patent Abstracts of Japan for 09-296308 published on Nov. 18, 1997.
Patent Abstracts of Japan for 11-286803 published on Oct. 19, 1999.

* cited by examiner

*Primary Examiner*—Gloria M. Hale
(74) *Attorney, Agent, or Firm*—Darby & Darby

(57) ABSTRACT

A brassiere having a front fabric portion having front left and right shoulder portions, and front left and right underarm portions. A back fabric portion having a back left and right underarm portions connected to the respective front underarm portions, and an upper edge. A back shoulder fabric portion has a contractive force less than a contractive force of the back fabric portion, having a rear central portion connecting the front left and right shoulder portions, wherein a first width of the rear central portion is less than a width between the front left and front right shoulder portions at a point where the front left and front right shoulder portions contact the shoulders of the wearer, the rear central portion connected to the upper edge of the back fabric portion and the rear central portion having a second width near the upper edge of the back fabric portion wider than the first width.

26 Claims, 8 Drawing Sheets

WOMAN'S CLOTHING HAVING A FUNCTION OF PROTECTING A BREAST

TECHNICAL FIELD

The present invention relates to a women's clothing with breasts protective function, and is more preferably applied to a sports brassiere to be worn in athletic activities.

BACKGROUND ART

Conventionally, there has been provided various types of brassieres that are suitable to sports. For example, Japanese Utility Model Application Laid-Open Publication No. Sho 57-154705 discloses a sports brassiere where the whole circumferences of the cups are enclosed by a stretchy net tape. Further, Laid-open Japanese Utility Model Application Laid-Open Publication No. Sho 59-125910 discloses a sports brassiere with a stretchy thin net cloth fixed with curving on the underarm portions. They both absorb an inertial force produced on the bust during an athletic activity by means of the stretchy net material, to control the bust moving wildly up and down, side to side, and back and forth.

Moreover, Japanese Patent Application Laid-Open Publication No. Hei-9-296308 discloses a sports brassiere which has a wire underneath and is provided with a pocket portion in the lower part of each cup to store a bust pad. According to the explanation of this, it is possible to prevent peripheral muscle from being fed with an unreasonable burden, even if the breasts bounce during a vigorous athletic activity.

Japanese Patent Application Laid-Open Publication No. Hei 11-286803 discloses a brassiere which controls movement of the breasts during an athletic activity by providing cup portions with a stretchy protective tape. This brassiere is excellent in terms of being able to control the movement of the breasts without giving a pressure onto the chest and breasts of a wearer, and is commercialized and extensively used as a sports brassiere.

The sports brassieres in Japanese Utility Model Application Laid-Open Publication No. Sho 57-154705 and Japanese Utility Model Application Laid-Open Publication No. Sho 59-125910 are insufficient in the functions for controlling movement of the bust, and the sports brassiere in Japanese Patent Application Laid-Open Publication No. Hei 9-296308 gives a pressure onto the chest section. The sports brassiere in Japanese Patent Application Laid-Open Publication No. Hei 11-286803 improves, mainly, the structures of the cup portions, whereby it is possible to control the movement of the bust and to reduce the pressure given onto the chest section including the bust.

DISCLOSURE OF THE INVENTION

An object of the present invention is to provide a women's clothing with a breasts protective function for controlling movement of the bust during an athletic activity, while reducing a burden given onto the chest or shoulders of a wearer, by improving mainly the structures of sections other than the cup portions.

The women's clothing with a breasts protective function of the present invention comprises:

a front fabric portion which elastically stretches in a state of tension produced when wearing the clothing, and covers the chest section including the right and left breasts of a wearer, and in which the upper sections of the right and left top regions where the nipples are positioned in a worn state extend to the right and left shoulder portions of the wearer;

a back fabric portion in which both ends thereof are connected to the both underarm portions of the front fabric portion, and which stretches elastically at least in the horizontal direction in a state of tension produced when wearing the clothing, to fit to the back of the wearer; and a back shoulder fabric portion which extends upward from the upper edge of the back fabric portion, and is connected to the front fabric portion at the right and left shoulder portions of the wearer, and in which a contractive force is reduced more than the back fabric portion, wherein in the back shoulder fabric portion, the right and left shoulder portions are united in the rear center of the back shoulder fabric portion so as to be narrower than the space between the right and left shoulder portions; this splits and extends upward to the right and left from this rear center, and, from this rear center to the lower part of the back shoulder fabric portion, is made to become wider towards the upper edge of the back fabric portion.

In the women's clothing according to the present invention, the front fabric portion preferably comprises a fabric material for covering the chest section, and a breasts protective fabric material which elastically stretches in a state of tension produced when wearing the clothing.

In the women's clothing according o the present invention, the front fabric portion preferably is constituted by layering two pieces of fabric and interposing between the two pieces of fabric the breasts protective fabric which extends upward from at least the top region and is connected to the back shoulder fabric portion.

In the women's clothing according to the present invention, the rear central portion of the upper edge of the back fabric portion is preferably positioned lower than the underarm portions.

In the women's clothing according to the present invention, the upper edge of the back fabric portion curves downward, and the lower edge of same is preferably linear in the horizontal direction.

In the women's clothing according to the present invention, the width of the back fabric portion is preferably narrowest at its rear central portion and becomes wider towards the underarm portions.

In the women's clothing of the present invention, an under tape material having a larger contractive force than that of the fabric material constituting the back fabric portion is preferably stitched on the lower edge of the front fabric portion and the lower edge of the back fabric portion.

In the women's clothing according to the present invention, the back fabric portion preferably has a configuration in which a first fabric material having a small contractive force is stitched on a second fabric material having a large contractive force, and the back shoulder fabric material preferably is constituted by the first fabric material.

In the women's clothing according to the present invention, the second fabric material is preferably a power net stitched on a skin side of the first fabric material.

In the women's clothing according to the present invention, the back shoulder fabric portion preferably has a Y-like shape, T-like shape, or X-like shape.

BEST MODE FOR CARRYING OUT THE INVENTION

Figure 1:
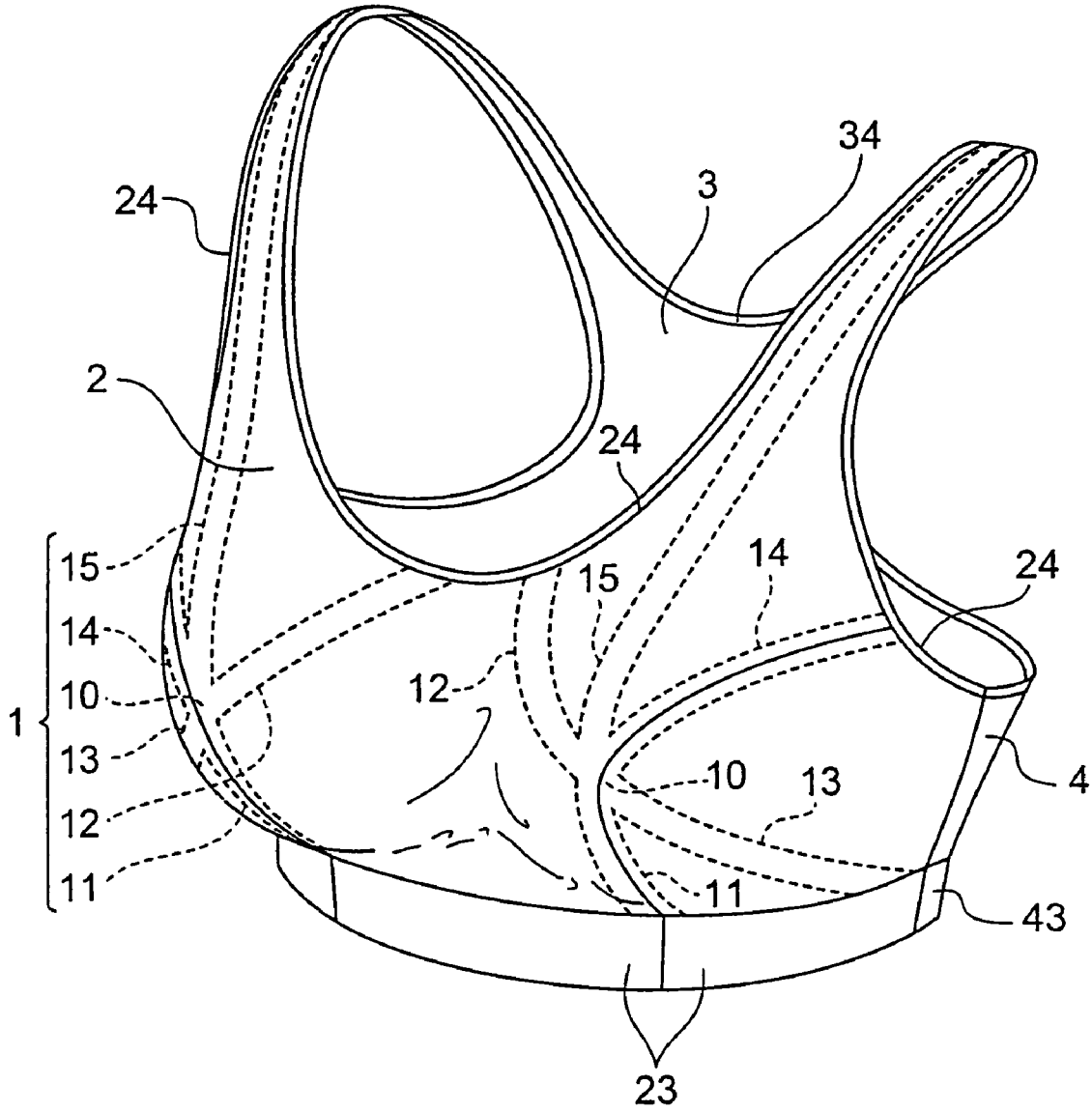
FIG. 1 is a perspective view of the sports brassiere according to a preferred embodiment of the present invention.

As shown in FIG. 1 and FIGS. 2*a*–2*d*, a front fabric portion 2 comprises cup portions for covering the chest section including the right and left breasts, and a front shoulder portion extending to the left and right shoulder portions of a wearer. The front fabric portion 2 is constituted by layering two pieces of fabric, a skin side front fabric 21 and fore side front fabric 22, and stretchy under tapes 23 constituting a part of the front fabric portion 2 are stitched on the lower edge of the front fabric portion 2. A contractive force in the longitudinal direction of these under tapes 23 is increased by placing a rubber or the like, which is not shown in the figure, inside the under tapes 23.

A stretchy bias tape 24 is stitched on the upper edge portion of the front shoulder portion of the front fabric portion 2. Except for the seam portions on the lower edge portion on which the under tape 23 is stitched, the upper edge portion on which the bias tape 24 is stitched, and the back fabric portion 4 at the underarms, two pieces of fabric 21, 22 that constitute the front fabric portion 2 are not sewn or stitched together; which means that this is in the form of "a pouch with no mouth."

Figure 2:
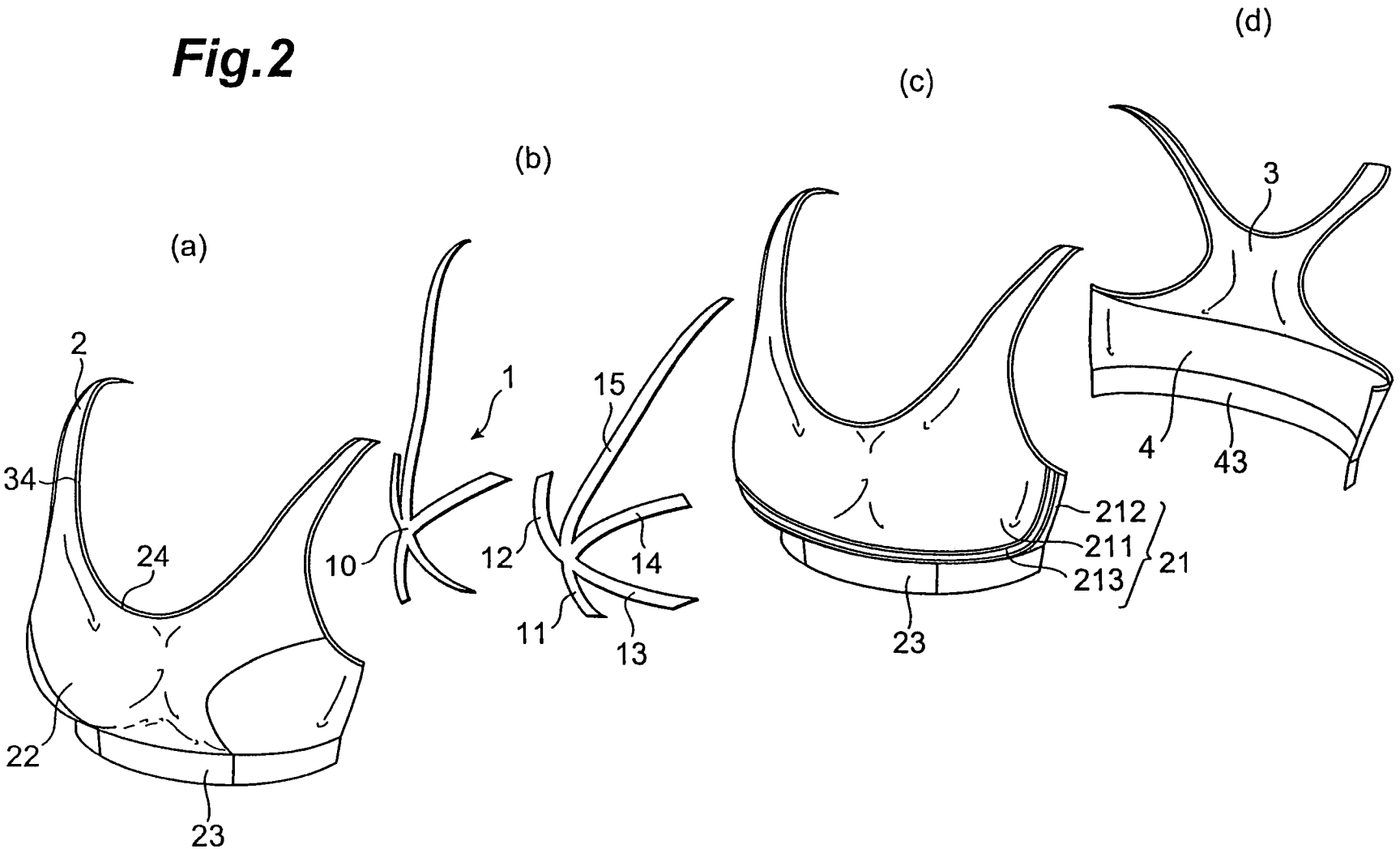
FIGS. 2*a*–2*d* illustrate is an exploded perspective view of the brassiere of FIG. 1.

In the pouch constituted by these two pieces of fabric 21, 22, a tape-like breasts protective fabric material 1 that extends radially is sandwiched, as indicated by the dashed lines in FIG. 1. This breasts protective fabric material 1 made of a stretchy material is a tape material formed in the radial pattern, and is interposed between the skin side front fabric 21 and fore side front fabric 22, as shown in FIG. 2.

A middle tape portion 10 of the breasts protective fabric material 1 is fitted to the nipple when the brassiere is being worn, and by centering this, five tape portions 11 to 15 extend. Specifically, an anteroinferior tape portion 11 is disposed along the line that connects the top region where the nipple is positioned and the anterior center side lower part region where the anterior center side lower part of the breast is positioned; an anterosuperior tape portion 12 is disposed along the line that connects the top region and a anterior center side upper part region where the anterior center side upper part of the breast is positioned; an underarm lower tape portion 13 is disposed along an underarm line that connects the top region and the underarm side lower part region where the underarm side lower part of the breast is positioned; an underarm upper tape portion 14 is disposed along the line that connects the top region and the underarm side upper part region where the underarm side upper part of the breast is positioned; and an upper breast tape portion 15 is disposed along the line that connects the top region and the breast upper part region where an upper part of the nipple of the breast is positioned.

Further, ends of the anteroinferior tape portion 11 and the underarm lower tape portion 13 are stitched on the under tape 23 at the lower edge of the front fabric portion 2, the anterosuperior tape portion 12 is stitched on the bias tape 24 at the anterior center side upper edge of the front fabric portion 2, the underarm upper tape portion 14 is stitched on the bias tape 24 at the underarm side upper edge of the front fabric portion 2, and the upper breast tape portion 15 is brought into contact with and stitched on the upper edge of the back shoulder fabric portion 3 at the shoulder portion of the wearer. Note that the front shoulder portions of the front fabric portion 2 extend to the shoulder portions as the widths of the front shoulder portion narrow gradually towards the upper part of the top regions where the right and left nipples are positioned when the brassiere is being worn, and the width of the front shoulder portion narrows just before the shoulder portion to the same degree as the width of the upper breast tape portion 15. Moreover, the width of the upper breast tape portion 15 as well is formed such that the width thereof narrows gradually upward, thereby alleviating the pressure onto the shoulder of the wearer. For example, the upper breast tape portion 15 is 3.3 cm wide in the proximity of the top region, but narrows upward from the middle and becomes 2.6 cm wide at the tip portion.

In the breasts protective fabric material 1, only the ends of the five tape portions 11 to 15 extending radially are stitched on the front fabric portion 2, while other portions can move freely with respect to the fabric 21, 22 of the front fabric portion 2. Moreover, the breasts protective fabric material 1 stretches more easily than the fabric 21, 22 of the front fabric portion 2, and is formed by a material with a large contractive force, whereby it is possible to follow complicated and vigorous movement of the breasts during an athletic activity.

As above, in the brassiere of the present embodiment, the breasts protective fabric material 1 with the radially extending five tape portions 11 to 15 is provided so as to be able to move freely with respect to the fabric 21, 22 of the front fabric portion 2, and, the width of the upper breast tape portion 15 narrows towards the tip, thereby allowing the breasts to move freely in a certain range, and at the same time dispersing the counterforce of the breasts, which is generated by controlling the movement of the breasts, to the underarms and shoulders of the wearer. Therefore, even in a case of particularly large breasts, big movement of the bust can be controlled with no unreasonable burden to be produced on the shoulders, and without giving a pressure onto the chest section.

As shown in FIG. 2*c*, the skin side front fabric 21 is sectioned by a cup fabric 211 that covers the breasts and an under fabric 212 that covers the underneath of the breasts, between which a stretch tape 213 made of a net material is stitched so as to follow the lower edge of the verge's line of the breasts when the brassiere is being worn. Because of this provided stretch tape 213, the cup portions are fitted nicely to the breasts, and the function for controlling the movement of the breasts is further improved.

Figure 3:
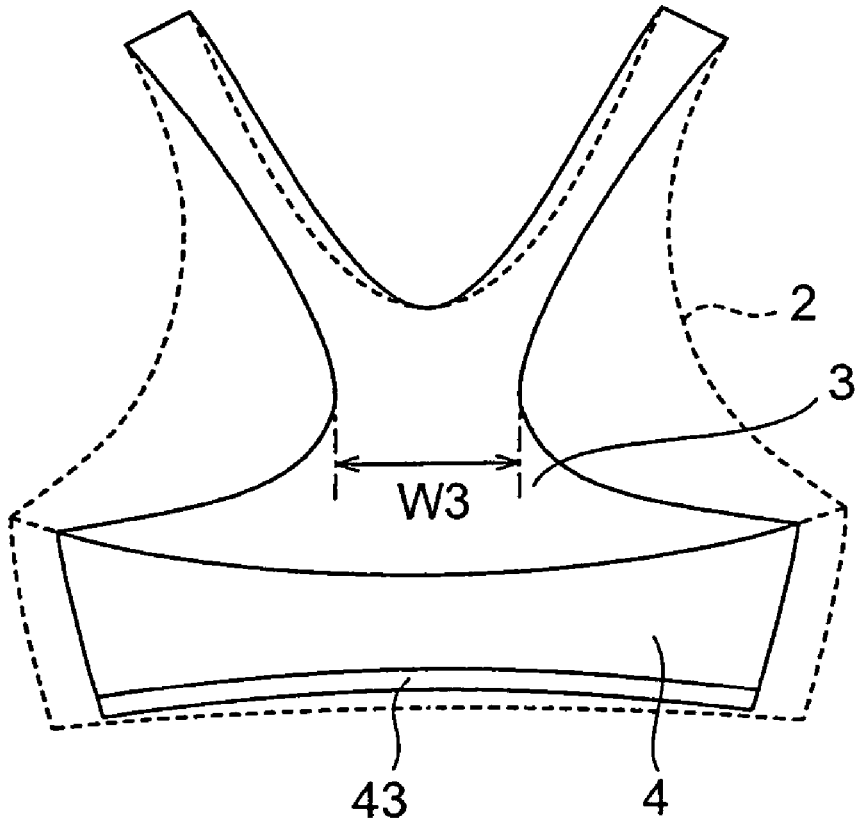
FIG. 3 is a plan view in which the brassiere is spread planimetrically, and the fabric material of the front side is illustrated by a dashed line, while the fabric material of the back side by a solid line.

Next, the configurations of the back shoulder fabric portion 3 and back fabric portion 4 will be explained in detail. FIG. 3 is a plan view in which the brassiere according to the preferred embodiment is spread, and the fabric material of the front side is illustrated by a dashed line, while the fabric material of the back side by a solid line. FIGS. 5, 6, 7 and 8 are also plan views with illustrations of the same sort. Characteristics of the present invention are expressed most clearly also in these plan views.

The right and left upper edges of the back shoulder fabric portion 3 are connected to the upper edges of the right and left front shoulder portions of the front fabric portion 2 by means of stitching. From here, the tip (lower end) of the back shoulder fabric portion 3 extending downward on the back of the wearer continues to the upper edge of the back fabric portion 4. Both ends of the back fabric portion 4 are connected to the underarm portions of the front fabric portion 2 by means of stitching, are stretched elastically to the vertical and horizontal directions in a state of tension produced when wearing the brassiere, and are fitted to the back of the wearer. Note that the back fabric portion 4 is comprises an integral fabric such as a power net and is not separated right and left, thus the rear center is not provided with a hook as the connector. A stretchy under tape 43 configuring a part of the back fabric portion 4 is stitched on the lower edge of the back fabric portion 4. The contractive force of the under tape 43 is strengthened by placing a rubber or the like therein, as with the under tapes 23 in the front fabric portion 2.

The back shoulder fabric portion 3 is formed by a single cloth having stretchability and a contractive force, and this cloth is also a material for the outside of the back fabric portion 4. In other words, this cloth constituting the back shoulder fabric portion 3 extends from the upper edge of the back fabric portion 4 to the lower edge of the back fabric portion 4 at the lower part, and the skin side of the fabric is stitched with the abovementioned power net, which leads that the contractive force of the back fabric portion 4 becomes larger than that of the back shoulder fabric portion 3. Specifically, the difference between the contractive forces in cases where both the back shoulder fabric portion 3 and back fabric portion 4 are formed to have the same width and are stretched by the same length may be, desirably, 1.5 to 5 times, and more preferably 2 to 3 times.

As indicated by the solid line in FIG. 3, the back shoulder fabric portion 3 is cut into a U-like shape at the rear center from the sides and the top, and wide straps extend by forming the Y-like shape from the rear center of the wearer towards the right and left shoulder portions. The width of the rear center in the horizontal direction is made narrower than the space between the right and left straps on the shoulder portions of the wearer, and this narrowness is obvious when comparing it with the front fabric portion 2 illustrated by the dashed line. Specifically, the width of the back shoulder fabric portion 3 at a section where the width is narrowest (length denoted by W3 in FIG. 3) may be, desirably, 7 to 20%, and more preferably 10 to 15%, with respect to the entire width of the back shoulder fabric portion 3.

Figure 4:
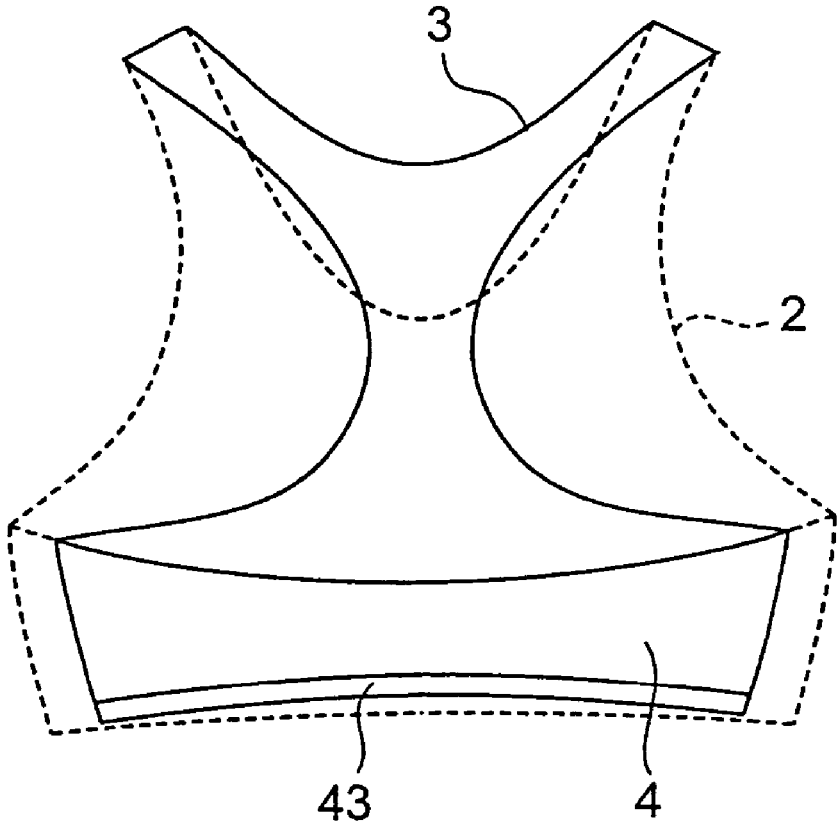
FIG. 4 is a plan view showing the shape of the back shoulder fabric portion by planimetrically spreading a brassiere different from the example of FIG. 3, where the fabric material of the front side is illustrated by a dashed line, and the fabric material of the back side by a solid line.
Figure 5:
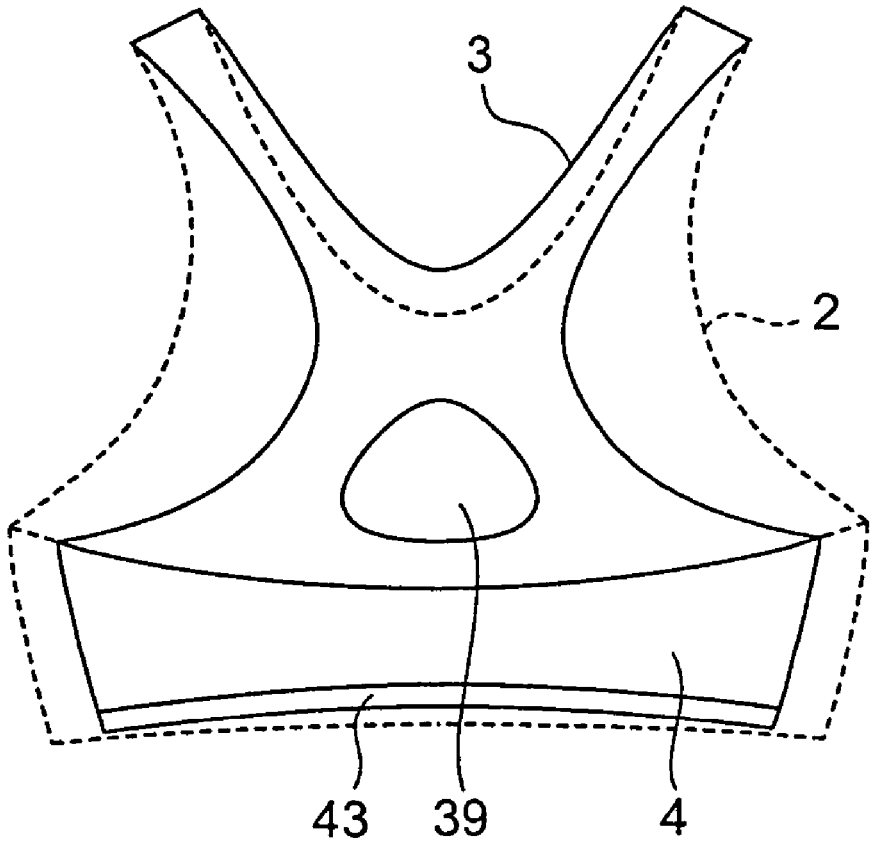
FIG. 5 is a plan view showing the shape of the back shoulder fabric portion by planimetrically spreading a brassiere different from the examples of FIG. 3 and FIG. 4, where the fabric material of the front side is illustrated by a dashed line, and the fabric material of the back side by a solid line.

The shape of the back shoulder fabric portion 3 may be in the "T-like shape" of FIG. 4 or "X-like shape" of FIG. 5, instead of the "Y-like shape" of FIG. 3. In the case of the "T-like shape" of FIG. 4, the rear center is thin and long in the vertical direction, and the wide straps extend to the directions of right and left shoulder portions from the upper portion of the rear center. In the case of the "X-like shape" of FIG. 5, there is formed a hole 39 in the lower side of the rear center of the back shoulder fabric portion 3. In both cases, the width of the back shoulder fabric portion 3 at its narrowest part may be, desirably, 7 to 20%, and more preferably 10 to 15%, with respect to the entire width of the back shoulder fabric portion 3, as with the case of FIG. 3.

In the examples shown in FIGS. 3, 4 and 5, the shape of the back fabric portion 4 is such that the lower edge on which the under tape 43 is stitched is made substantially linear, and the upper edge continuing to the back shoulder fabric portion 3 forms a curved line with downward curving. Further, the length of the lower edge of the back fabric portion 4 in the horizontal direction is made shorter than the length of the upper edge of same in the horizontal direction, and moreover, the length of the lower edge of the back fabric portion 4 in the horizontal direction is made shorter than the length of the lower edge of the front fabric portion 2 in the horizontal direction.

Since the upper edge of the back fabric portion 4 forms a curved line with downward curving, the width of the back fabric portion 4 is made wide at both sides, and is made narrow at the middle. Also, the width in the vertical direction of the back shoulder fabric portion 3 continuing to the upper edge of the back fabric portion 4 becomes wider gradually from both right and left sides. Therefore, even when forming the back shoulder fabric portion 3 into Y-, T-, or X-like shape in order to improve the functionality of physical mobility, it is possible to prevent a disadvantage that the rear center of the back shoulder fabric portion 3 rides up at the back of the wearer. The brassiere according to the preferred embodiment comprises, in the front fabric portion 2, the breasts protective fabric material 1 in the radial pattern and is made such that the weight of the breasts and the counterforce when the breasts bounce are introduced to the upper ends of the back shoulder fabric portion 3 through the breasts protective fabric material 1. Thus, by forming the back shoulder fabric portion 3 into the Y-, T- or X-like shape to allow the wearer to easily move the upper body (especially the arms), the rear center rides up at the back of the wearer. However, the width of the back fabric portion 4 is made wider on the both sides, and the width in the vertical direction of the back shoulder fabric portion 3 is made to become wider gradually from the right and left sides towards the center, thus the disadvantage of "riding up" is not produced.

Figure 6:
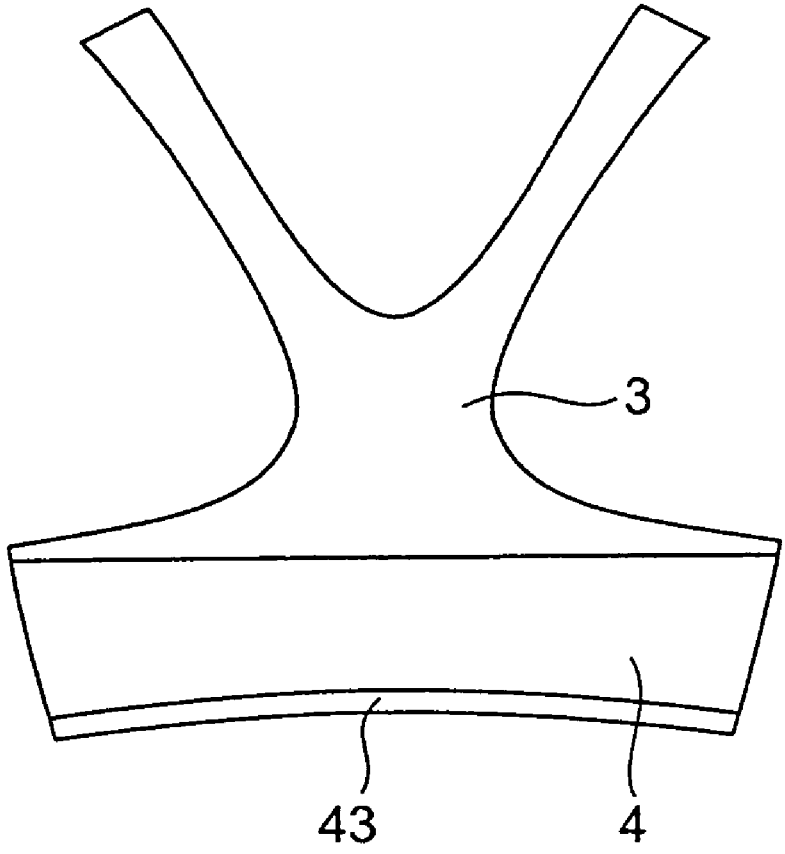
FIG. 6 is a plan view showing the shape of the back fabric portion by planimetrically spreading a brassiere different from the example of FIG. 3, where the fabric material of the front side is illustrated by a dashed line, and the fabric material of the back side by a solid line.

In the example shown in FIG. 6, the upper edge of the back fabric portion 4 is made substantially linear, thus the functionality of preventing "riding up" becomes somewhat less. However, the width in the vertical direction of the back shoulder fabric portion 3 is made to become wider gradually from the right and left sides towards the center, and moreover, the back shoulder fabric portion 3 in the both right and left ends as well is made to have a fixed width in the vertical direction, thus the disadvantage of "riding up" can be lessened.

Figure 7:
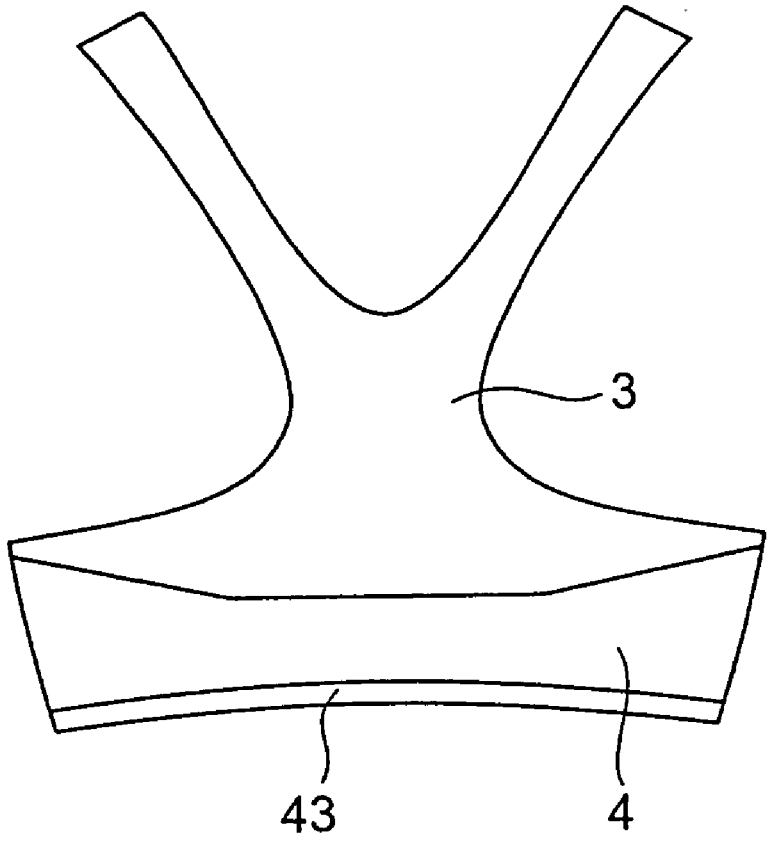
FIG. 7 is a plan view showing the shape of the back fabric portion by planimetrically spreading a brassiere different from the examples of FIG. 3 and FIG. 6, where the fabric material of the front side is illustrated by a dashed line, and the fabric material of the back side by a solid line.
Figure 8:
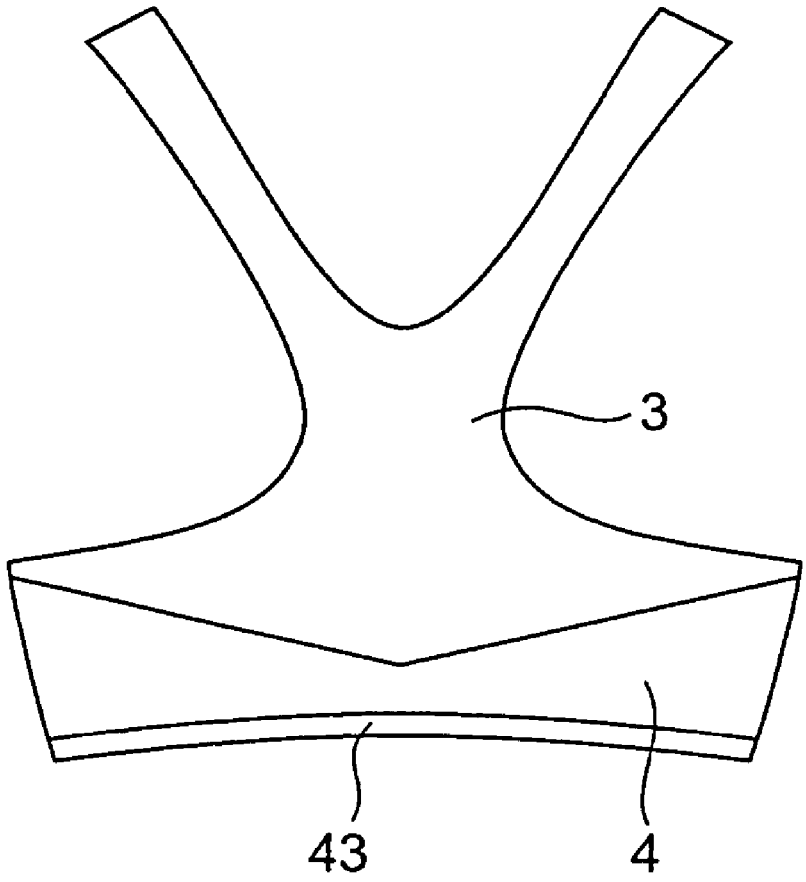
FIG. 8 is a plan view showing the shape of the back fabric portion by planimetrically spreading a brassiere which is different from the examples of FIG. 3, FIG. 6, and FIG. 7, where the fabric material of the front side is illustrated by a dashed line, and the fabric material of the back side by a solid line.

In the example shown in FIG. 7, the upper edge of the back fabric portion 4 is in the form of a broken line consisting of three straight lines, and the width in the middle section of the back fabric portion 4 is made approximately half of the entire length of the back fabric portion 4. In the example shown in FIG. 8, the upper edge of the back fabric portion 4 is in the form of a broken line consisting of two straight lines, and the width in the middle section of the back fabric portion 4 is made to become narrower gradually. Therefore, as with the examples shown in FIGS. 3, 4 and 5, it is possible to prevent the disadvantage that the rear center of the back shoulder fabric portion 3 "rides up."

The scope of the present invention is not limited to the embodiments disclosed herein, and can be changed accordingly within a scope in which the essence of the present invention is not lost.

The invention claimed is:

1. A women's clothing with a breasts protective function, comprising:

a front fabric portion which elastically stretches in a state of tension produced when wearing the clothing, and covers the chest section of a wearer including the right and left breasts of the wearer, and in which upper sections of right and left top regions of the clothing where the nipples are positioned in a worn state extend to right and left shoulder portions of the front fabric portion;

a back fabric portion in which both ends thereof are connected to right and left underarm portions of the front fabric portion, and which stretches elastically at least in the horizontal direction in a state of tension produced when wearing the clothing, to fit to the back of the wearer; and a back shoulder fabric portion which extends upward from an upper edge of said back fabric portion, and is connected to said front fabric portion at the right and left shoulder portions, and in which a contractive force is reduced more than said back fabric portion, wherein in said back shoulder fabric portion, the right and left shoulder portions are united in a rear central portion of the back shoulder fabric portion so as to be narrower than a space between said right and left shoulder portions; the rear central portion splits and extends upward to the right and left and becomes wider from a lower part of the back shoulder fabric portion towards the upper edge of said back fabric portion.

2. The women's clothing according to claim 1, wherein said front fabric portion comprises a fabric material for covering the chest section, and a breasts protective fabric material which elastically stretches in a state of tension produced when wearing the clothing.

3. The women's clothing according to claim 1, wherein said front fabric portion comprises two pieces of layered fabric and interposing between the two pieces of fabric the breasts protective fabric which extends upward from at least said top region and is connected to the back shoulder fabric portion.

4. The women's clothing according to claim 1, wherein the back fabric portion further comprises a center portion of the upper edge which is positioned lower than the underarm portions.

5. The women's clothing according to claim 2, wherein the back fabric portion further comprises a center portion of the upper edge which is positioned lower than the underarm portions.

6. The women's clothing according to claim 3, wherein the back fabric portion further comprises a center portion of the upper edge which is positioned lower than the underarm portions.

7. The women's clothing according to claim 1, wherein the upper edge of said back fabric portion curves downward, and a center portion of the upper edge is linear in the horizontal direction.

8. The women's clothing according to claim 2, wherein the upper edge of said back fabric portion curves downward, and a center portion of the upper edge is linear in the horizontal direction.

9. The women's clothing according to claim 3, wherein the upper edge of said back fabric portion curves downward, and a center portion of the upper edge is linear in the horizontal direction.

10. The women's clothing according to claim 1, wherein the width of said back fabric portion is narrowest at the rear central portion thereof and becomes wider towards the underarm portions.

11. The women's clothing according to claim 2, wherein the width of said back fabric portion is narrowest at the rear central portion thereof and becomes wider towards the underarm portions.

12. The women's clothing according to claim 3, wherein the width of said back fabric portion is narrowest at the rear central portion thereof and becomes wider towards the underarm portions.

13. The women's clothing according to claim 1, wherein an under tape material having a larger contractive force than that of the fabric material constituting said back fabric portion is stitched on the lower edge of said front fabric portion and the lower edge of said back fabric portion.

14. The women's clothing according to claim 2, wherein an under tape material having a larger contractive force than that of the fabric material constituting said back fabric portion is stitched on the lower edge of said front fabric portion and the lower edge of said back fabric portion.

15. The women's clothing according to claim 3, wherein an under tape material having a larger contractive force than that of the fabric material constituting said back fabric portion is stitched on the lower edge of said front fabric portion and the lower edge of said back fabric portion.

16. The women's clothing according to claim 1, wherein said back fabric portion has a configuration in which a first fabric material having a small contractive force is stitched on a second fabric material having a large contractive force, and said back shoulder fabric material is constituted by said first fabric material.

17. The women's clothing according to claim 2, wherein said back fabric portion has a configuration in which a first fabric material having a small contractive force is stitched on a second fabric material having a large contractive force, and said back shoulder fabric material is constituted by said first fabric material.

18. The women's clothing according to claim 3, wherein said back fabric portion has a configuration in which a first fabric material having a small contractive force is stitched on a second fabric material having a large contractive force, and said back shoulder fabric material is constituted by said first fabric material.

19. The women's clothing according to claim 16, wherein said second fabric material is a power net stitched on a skin side of said first fabric material.

20. The women's clothing according to claim 17, wherein said second fabric material is a power net stitched on a skin side of said first fabric material.

21. The women's clothing according to claim 18, wherein said second fabric material is a power net stitched on a skin side of said first fabric material.

22. The women's clothing according to claim 1, wherein said back shoulder fabric portion has a Y-like shape, T-like shape, or X-like shape.

23. The women's clothing according to claim 2, wherein said back shoulder fabric portion has a Y-like shape, T-like shape, or X-like shape.

24. The women's clothing according to claim 3, wherein said back shoulder fabric portion has a Y-like shape, T-like shape, or X-like shape.

25. A brassiere with a breast protecting function, comprising:

a front fabric portion of an elastic material being in tension when the brassiere is worn by a user and covering the breasts of the user, comprising:

a front left shoulder portion;

a front right shoulder portion;

a front left underarm portion; and a front right underarm portion;

a back fabric portion of an elastic material stretching at least in a horizontal direction and being in tension when the brassiere is worn by the user, comprising:

a back left underarm portion connected to the front left underarm portion;

a back right underarm portion connected to the front right underarm portion; and an upper edge;

a back shoulder fabric portion having a contractive force less than a contractive force of the back fabric portion, comprising:

a rear central portion having a first end connecting the front left and front right shoulder portions, wherein a first width of the rear central portion is less than a width between the front left and front right shoulder portions at a point where the front left and front right shoulder portions contact the shoulders of the wearer, the rear central portion having a second end connected to the upper edge of the back fabric portion and the rear central portion having a second width near the upper edge of the back fabric portion wider than the first width.

26. The brassiere with a breast protecting function according to claim 25, wherein the contractive force of the back shoulder fabric portion is less than 1.5 to 5 times the contractive force of the back fabric portion.

* * * * *